United States Patent [19]

Hopkins

[11] Patent Number: 4,586,279

[45] Date of Patent: May 6, 1986

[54] FOLDING DISPLAY ASSEMBLY

[76] Inventor: William G. Hopkins, 117 Merrifield Dr., Greenville, S.C. 29615

[21] Appl. No.: 666,103

[22] Filed: Oct. 29, 1984

[51] Int. Cl.[4] ..... G09F 1/10

[52] U.S. Cl. ..... 40/124.1; 446/151; 40/539

[58] Field of Search ..... 462/34; 40/124.1, 539, 40/421, 425

[56] References Cited

U.S. PATENT DOCUMENTS

| | | | |
|---|---|---|---|
| 1,130,782 | 3/1915 | Willens | 40/124.1 |
| 1,620,053 | 3/1927 | Arundel | 446/343 |
| 2,680,328 | 6/1954 | Youngren | 446/151 |
| 2,988,845 | 8/1961 | MacDougal | 446/151 |

FOREIGN PATENT DOCUMENTS

| | | | |
|---|---|---|---|
| 723854 | 2/1955 | United Kingdom | 40/124.1 |

*Primary Examiner*—Gene Mancene
*Assistant Examiner*—Wenceslao J. Contreras
*Attorney, Agent, or Firm*—Bailey & Hardaway

[57] ABSTRACT

A display card having interconnected distinct panels in an "L"-shaped configuration cut or stamped from paperboard, cardboard, or the like, with cooperating printed matter positioned on selected portions thereof so that upon folding the panels about score lines the printed matter will cooperate to complete a picture as well as in some instances enabling motion to be imparted thereto by moving one of the panels relative to the other.

2 Claims, 2 Drawing Figures

FOLDING DISPLAY ASSEMBLY

BACKGROUND OF THE INVENTION

Display cards of various configurations and design are known in the prior art and are typified by U.S. Pat. Nos. 1,257,067; 1,259,297; 3,566,483; 3,946,508 and 4,054,242.

Generally, the patentees of the above concern themselves with the making of moveable display cards which are economical, simple in construction, relatively durable, and entertaining.

The present invention falls into this category and distinguishes itself therefrom by providing a display card which is considerably simpler in all respects to that which is disclosed or contemplated.

SUMMARY OF THE INVENTION

The display card of the present invention relates to a moveable exhibitor cut from relatively inexpensive material, such as paperboard or cardboard, in an "L"-shaped configuration with at least three panels folded one over the other to form a compact package. Printed matter is disposed on selected portions of the panels to cooperate with each other to complete a moveable picture, message, or the like by moving one panel relative to the other.

DETAILED DESCRIPTION OF THE INVENTION

Figure 1:
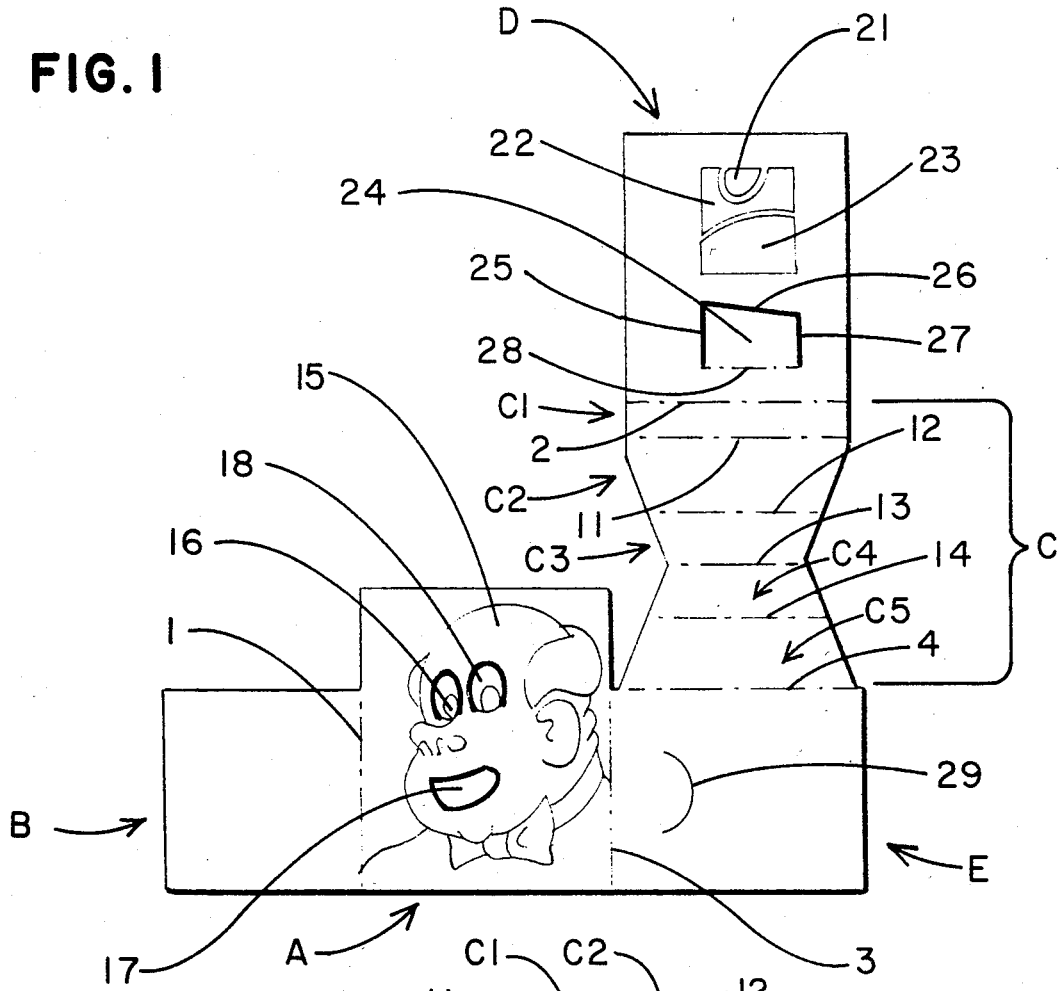
FIG. 1 is a planar view of the "L"-shaped display card in an unfolded position.
Figure 2:
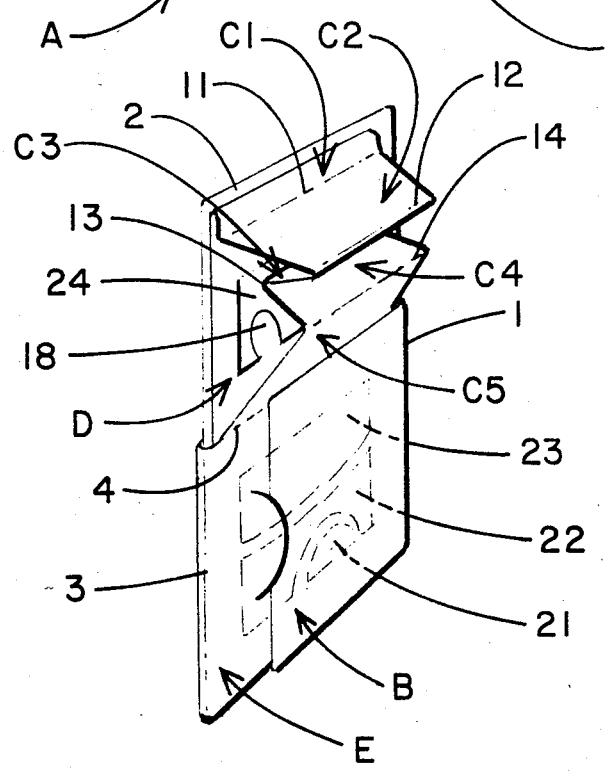
FIG. 2 is a rearward perspective view of the display card in its folded position.

With reference to FIG. 1, the display device of the invention comprises a generally "L" shaped blank of flexible material 10 having first and second legs connected by a corner panel. The first leg comprises an inner panel A and an outer panel B connected by a first folding score 1. The second leg comprises an inner panel C and an outer panel D connected by a second folding score 2. The corner panel E is connected to inner panel A by a third folding score 3 and to inner panel C by a fourth folding score 4. The panels can be folded about the score lines in an overlapping relationship so as to form a compact unit.

Generally speaking, central panel A is provided with printing thereon and constitutes the main theme of the message to be conveyed by the display device. In this instance, panel A is printed with a caricature of a man's face 15, having a pair of eyes 16 and a mouth opening 17. Eyes 16 comprise a pair of tabs hinged about line 19, 19 for pivotal movement thereabout.

Panel D is printed to cooperate with the printed material 15 of panel A with the portion 20 being colored, by way of example, in areas 21, 22, and 23. Area 24 is a generally rectangular section with three sides 25, 26, 27 thereof being severed therefrom and hinged for movement about the line 28, 28 so as to form a tab.

The coloring of panel D and the shape of area 24 are designed to cooperate with the face 15 of panel A when the "L" shaped blank 10 is foled into an operative structure so as to position panel D rearwardly of panel A.

In this manner, the colored portion 20 is disposed rearwardly of mouth opening 17 with the tab 24 being positioned adjacent the eyes so that upon imparting a vertical reciprocatory motion to panel D, it will appear that the mouth 17 and eyes 16 of the face 15 are moving.

The "L" shaped blank 10 is assembled into an operative structure by:

folding said panel D rearwardly about score line 2 so as to superimpose panel D over the backside of panel C;

folding panel C1 forwardly about score line 11;

folding panel C2 rearwardly about score line 12;

folding panel C3 forwardly about score line 13;

folding C4 rearwardly about score line 14; and folding panel C5 forwardly about said score line 4, with the result being that panel D is superimposed over the back-side of panel E with panel C being arranged in an accordian-shaped, spring-like mechanism. Said panel E is then folded about score line 3 so as to dispose the printed matter of panel D behind the printed matter of panel A with tab 24 being inserted forwardly of eye tabs 18,18. Said panel B is then folded about score line 1 and disposed rearwardly of panel E and is locked thereto by inserting the same into slot 29 to form a compact package.

A process for using the operative structure comprises grasping the folded panel C and imparting a squeezing motion thereto causing said printed matter of said panel D to move relative to that of said panel A, causing the eyes 16 and mouth 17 of the face 15 to open and close.

The display device can be cut or stamped from paperboard, cardboard, heavy paper of the like and printed simultaneously. It is considered to be within the purview of present disclosure to vary the printed matter in lieu of the face as disclosed; e.g., a question and answer format can be utilized.

That which is claimed is:

1. A display device, comprising:

a generally "L"-shaped blank of flexible material (10) having first and second legs connected by a corner panel;

said first leg having an inner panel (A) and an outer panel (B) connected by a first folding score (1);

said second leg having an inner panel (C) and an outer panel (D) connected by a second folding score (2); and said corner panel (E) connected to said inner panel (A) by a third folding score (3) and connected to said inner panel (C) by a fourth folding score (4) and wherein said "L"-shaped blank is assembled into an operative structure by:

folding said panel D rearwardly about said score line 2 so as to superimpose said panel D over the back-side of said panel C;

folding panel C1 forwardly about score line 11;

folding panel C2 rearwardly about score line 12;

folding panel C4 rearwardly about score line 14; and folding panel C5 forwardly about said score line 4, with the result being that said panel D is superimposed over the back-side of said panel E with said panel C being arranged in an accordian-shaped, spring-like mechanism; said panel E being then folded about said score line 3 so as to dispose the printed matter of said panel D behind the printed matter of said panel A with tab 24 being inserted forwardly of eye tabs 18; said panel B being folded about said score line 1 and disposed rearwardly of said panel E and locked thereto by inserting the said panel E into slot 29 to form a compact package.

2. A process for using the structure set forth in claim 1 comprising grasping the folded panel C and imparting a squeezing motion thereto causing said printed matter of said panel D to move relative to that of said panel A, causing the eyes 16 and mouth 17 of the face 15 to open and close.

* * * * *